United States Patent [19]

Vielhauer

[11] Patent Number: 4,979,905

[45] Date of Patent: Dec. 25, 1990

[54] MOTOR-VEHICLE LAMP ASSEMBLY

[75] Inventor: Werner Vielhauer, Kierspe, Fed. Rep. of Germany

[73] Assignee: Hugo Schnippering GmbH & Co. K.G., Kierspe, Fed. Rep. of Germany

[21] Appl. No.: 485,375

[22] Filed: Feb. 26, 1990

[51] Int. Cl.[5] ..... H01R 4/60

[52] U.S. Cl. ..... 439/206; 439/271; 439/701

[58] Field of Search ..... 439/190–206, 439/168, 182, 220, 280, 356, 360, 375, 661–667, 701, 702–707, 271

[56] References Cited

U.S. PATENT DOCUMENTS

| | | | |
|---|---|---|---|
| 2,710,386 | 6/1955 | Hall | 439/206 |
| 4,528,619 | 7/1985 | Dolan et al. | 439/375 |

FOREIGN PATENT DOCUMENTS

| | | | |
|---|---|---|---|
| 942821 | 5/1956 | Fed. Rep. of Germany | 439/666 |
| 621112 | 5/1961 | Italy | 439/666 |
| 861932 | 3/1961 | United Kingdom | 439/168 |
| 931800 | 7/1963 | United Kingdom | 439/206 |

*Primary Examiner*—David L. Pirlot

*Attorney, Agent, or Firm*—Herbert Dubno; Andrew Wilford

[57] ABSTRACT

A lamp assembly has a holder having a cup-shaped seat having an inner surface and a backwardly directed end and a socket engageable in the seat. This socket is formed with a forwardly open recess adapted to fit around a base of a bulb, an outer surface, a rear end formed with a flange having a forwardly directed face confronting the holder back end, an annular compartment formed in the rear end, a forwardly open front passage opening into the compartment, and a rearwardly open back passage opening into the compartment. Thus a fluid, water or moisture-laden air, can pass from inside the assembly through the front passage, then through the compartment, and finally through the back passage to outside the assembly. Contacts extending through the socket have outer ends adapted to be connected to wiring and inner ends exposed in the recess and engageable with a bulb therein. Formations between the socket and the holder retain same together. An O-ring is compressed between the flange face and the holder end and between the holder inner surface and flange outer surface.

8 Claims, 1 Drawing Sheet

MOTOR-VEHICLE LAMP ASSEMBLY

FIELD OF THE INVENTION

The present invention relates to a motor-vehicle lamp assembly. More particularly this invention concerns a socket assembly for holding an electric bulb on a motor vehicle.

BACKGROUND OF THE INVENTION

A standard motor-vehicle lamp assembly, such as for example used for a running light, has a holder forming a normally forwardly flared reflector and having a cylindrical base forming a seat into which is fitted a bulb-receiving socket. This socket fits with screwthread or bayonet formations in the holder and is provided with contacts that connect at their front ends with terminals on the bulb in the socket and at their rear ends with a plug leading to the motor-vehicle wiring. Such an arrangement is described in German utility model No. 8,806,515.

The problem with the known arrangements is that they make little or inadequate provision for evacuating liquid and/or moisture-laden air from the interior of the fixture. Where such provision is made it is either so simple that it also allows liquid to get back into the fixture by the same route, or is so complicated that it substantially elevates the cost of the assembly.

OBJECTS OF THE INVENTION

It is therefore an object of the present invention to provide an improved lamp assembly for a motor vehicle.

Another object is the provision of such an improved lamp assembly for a motor vehicle which overcomes the above-given disadvantages, that is which effectively allows liquid and moisture-laden air to be evacuated from the assembly while inhibiting reverse travel of such liquid or air.

A further object is to provide such a lamp assembly which has all the above-given advantages but which does not cost significantly more than the prior-art systems to manufacture.

SUMMARY OF THE INVENTION

A lamp assembly according to the invention has a holder having a cup-shaped seat having an inner surface and a backwardly directed end and a socket engageable in the seat. This socket is formed with a forwardly open recess adapted to fit around a base of a bulb, an outer surface, a rear end formed with a flange having a forwardly directed face confronting the holder back end, an annular compartment formed in the rear end, a forwardly open front passage opening into the compartment, and a rearwardly open back passage opening into the compartment. Thus a fluid—water or moisture-laden air—can pass from inside the assembly through the front passage, then through the compartment, and finally through the back passage to outside the assembly. Contacts extending through the socket have outer ends adapted to be connected to wiring and inner ends exposed in the recess and engageable with a bulb therein. Formations between the socket and the holder retain same together. An O-ring is compressed between the flange face and the holder end and between the holder inner surface and flange outer surface.

Thus with the system of this invention a route is provided for a fluid to be evacuated from the interior of the lamp assembly. This route is constructed in such a manner that it does not add significantly to the construction cost of the assembly and also does not permit fluid to flow along it in the reverse direction. What is more, the socket according to this invention can readily be used as a replacement part in a standard lamp assembly not originally provided with such venting capacity.

In accordance with a further feature of this invention the socket has an inner wall forming the recess and an outer wall formed with the respective formation. These walls are spaced and define between themselves the front passage. In addition the walls are basically cylindrical and the inner wall is provided with formations shaped to fit with the bulb.

The recess and seat according to the invention are concentric and centered on a generally horizontal axis and the front passage is above the back passage, that is not in line therewith so the path for exiting fluid is not a straight one. The back passage includes a lowermost liquid drain passage and, offset by about 45° thereto, at least one air vent passage. These drain and vent passages are formed as outwardly open notches cut in the flange.

DESCRIPTION OF THE DRAWING

The above and other objects, features, and advantages will become more readily apparent from the following, reference being made to the accompanying drawing in which.

SPECIFIC DESCRIPTION

Figure 1:
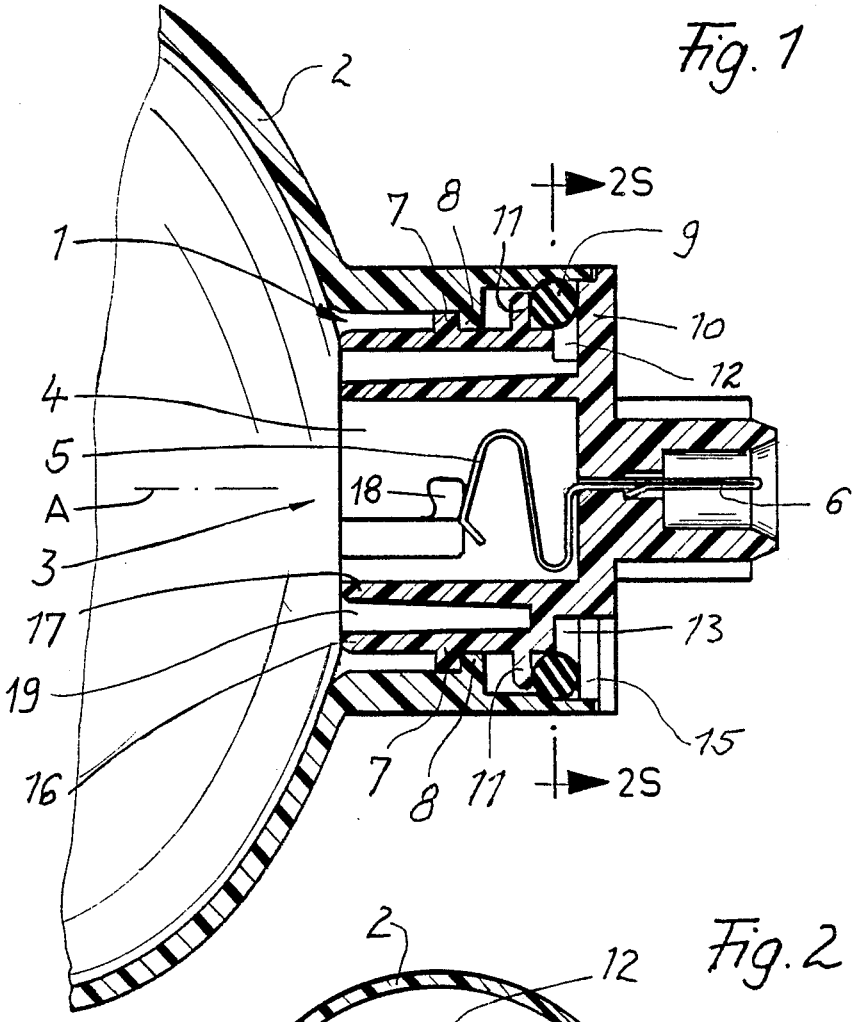
FIG. 1 is an axial section through the lamp assembly according to this invention.
Figure 2:
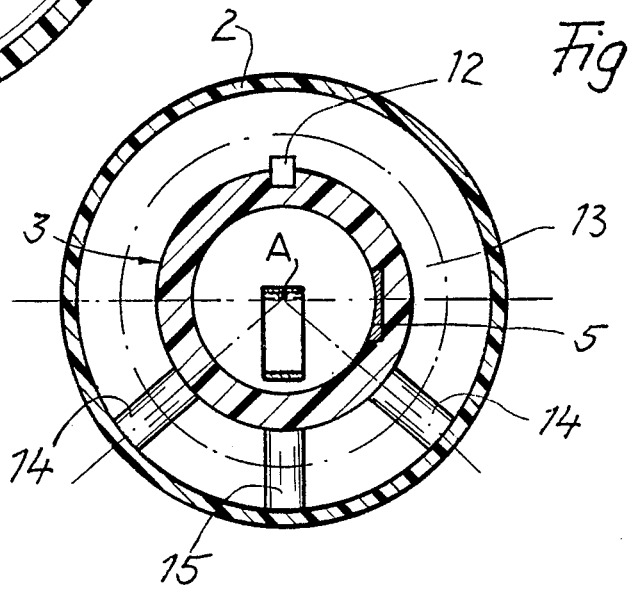
FIG. 2 is a section taken along line 2S—2S of FIG.

As seen in FIGS. 1 and 2 a lamp assembly according to this invention has a generally cylindrical holder 1 centered on a normally horizontal axis A and formed with a forwardly directed reflector 2. A socket 3 also centered on the axis A fits in the holder 1 and has concentric and cylindrical outer and inner walls 16 and 17 and a rear end formed mainly by a flat flange 10 that interconnects the walls 16 and 17. The outer wall 16 is formed with outwardly projecting tabs 7 that fit bayonet-fashion wit inwardly directed tabs 8 formed on the inner wall of the holder 1, and is also formed adjacent its rear (right-hand in FIG. 1) end with a radially outwardly projecting rib 11 having an axially rearwardly directed annular face. The inner wall 17 forms a cylindrical bulb-receiving recess 4 centered on the axis A and has two J-shaped grooves 18 for bayonet-style engagement of standard mounting tabs on a standard bulb base.

Contacts 5 which may be formed as described in my copending patent application No. 07/345,620 have forward ends exposed in the recess 4 and rear ends formed as terminals 6 that are connected to the motor-vehicle wiring. An O-ring 9 is compressed axially between the flange 10 and the rib 11 and radially between the outer surface of the outer wall 16 and the inner surface of the holder 1.

According to this invention the socket 3 is formed with an annular passage 13 that lies radially immediately inside the O-ring 9. The two walls 16 and 17 form a forwardly open annular passage 19 that in turn opens at a small passage 12 into the uppermost region of the passage 13. In addition the flange 10 is formed diametrally opposite the passage 12 with a radially outwardly and axially backwardly open notch 15 forming a liquid-drain passage and, angularly offset to each side of the notch 15 by about 45°, with further such notches 14 forming air vents.

Thus moist air trapped inside the lamp fixture can move back along the passage 19 and through the upper opening 12 into the passage 13, then down along the annular compartment 13 and out the passages 14 and 15. The angular offset between he opening 12 on one side and opening 14 and 15 on the other makes it impossible for liquid to inadvertently get sprayed back into the light fixture, but ensures that any liquid or saturated gas in the fixture can get out of it.

I claim:

1. A lamp assembly comprising:

a holder having a cup-shaped seat having an inner surface and a backwardly directed end;

a socket engageable in the seat and formed with a forwardly open recess adapted to fit around a base of a bulb, an outer surface, a rear end formed with a flange having a forwardly directed face confronting the holder back end, an annular compartment formed in the rear end, a forwardly open front passage opening into the compartment, and a rearwardly open back passage opening into the compartment, whereby a fluid can pass from inside the assembly through the front passage, then through the compartment, and finally through the back passage to outside the assembly;

contacts extending through the socket and having outer ends adapted to be connected to wiring and inner ends exposed in the recess and engageable with a bulb therein;

formations between the socket and the holder for retaining same together; and an O-ring compressed between the flange face and the holder end and between the holder inner surface and socket outer surface.

2. The lamp assembly defined in claim 1 wherein the socket has an inner wall forming the recess and an outer wall formed with the respective formation, the walls being spaced and defining between themselves the front passage.

3. The lamp assembly defined in claim 2 wherein the walls are basically cylindrical.

4. The lamp assembly defined in claim 2 wherein the inner wall is provided with formations shaped to fit with the bulb.

5. The lamp assembly defined in claim 1 wherein the recess and seat are concentric and centered on a generally horizontal axis, the front passage being above the back passage.

6. The lamp assembly defined in claim 5 wherein the back passage includes a lowermost liquid drain passage and, offset by about 45° thereto, an air vent passage.

7. The lamp assembly defined in claim 6 wherein the drain and vent passages are formed as outwardly open notches cut in the flange.

8. A lamp assembly comprising:

a holder having a seat having a generally cylindrical inner surface centered on a generally horizontal axis and a backwardly directed end;

a socket engageable in the seat and formed with a generally cylindrical inner wall generally centered on the axis and forming a forwardly open recess adapted to fit around a base of a bulb, a generally cylindrical outer wall generally centered on the axis and forming an outer surface, the inner and outer walls forming a forwardly open annular front passage, a rear end formed with a flange having a forwardly directed face confronting the holder back end, an annular compartment formed in the rear end and open into the forwardly open annular passage, and a rearwardly open back passage opening into the compartment, whereby a fluid can pass from inside the assembly through the front passage, then through the compartment, and finally through the back passage to outside the assembly;

contacts extending through the socket and having outer ends adapted to be connected to wiring and inner ends exposed in the recess and engageable with a bulb therein;

formations between the outer wall of the socket and the holder for retaining the socket and the holder together; and an O-ring compressed between the flange face and the holder end and between the holder inner surface and socket outer surface.

* * * * *